US006640501B1

(12) United States Patent
Hussey

(10) Patent No.: US 6,640,501 B1
(45) Date of Patent: Nov. 4, 2003

(54) COLLAPSIBLE STAIR COVER

(76) Inventor: Darren E. Hussey, 17 Mercer Rd., Old Bridge, NJ (US) 08857

( * ) Notice: Subject to any disclaimer, the term of this patent is extended or adjusted under 35 U.S.C. 154(b) by 0 days.

(21) Appl. No.: 10/127,590

(22) Filed: Apr. 23, 2002

(51) Int. Cl.[7] ..... B62D 63/04; E04B 1/34

(52) U.S. Cl. ..... 52/3; 52/177; 52/182; 52/DIG. 12; 428/77

(58) Field of Search ..... 52/DIG. 12, 3, 52/182, 177; 428/141, 77, 128

(56) References Cited

U.S. PATENT DOCUMENTS 3,158,893 A * 12/1964 Smith ..... 16/4
3,559,231 A * 2/1971 Hill ..... 16/4
3,752,304 A * 8/1973 Alef ..... 428/43
3,762,985 A * 10/1973 Chaitman ..... 428/43
3,801,424 A * 4/1974 Robbins, Jr. ..... 428/43
4,060,947 A * 12/1977 Naka ..... 52/179
4,097,628 A * 6/1978 Cheris et al. ..... 428/43
4,137,356 A * 1/1979 Shoemaker et al. ..... 428/211
4,644,592 A * 2/1987 Small ..... 4/583
4,900,606 A * 2/1990 Sakaki ..... 428/99
4,991,789 A * 2/1991 Buerger ..... 280/164.1
4,998,391 A * 3/1991 Connew ..... 52/179
5,073,428 A * 12/1991 Lancelot et al. ..... 428/67
5,103,608 A * 4/1992 Andreo ..... 52/179
5,148,644 A * 9/1992 Weir ..... 52/300
5,157,804 A * 10/1992 Williams ..... 15/161
5,190,799 A * 3/1993 Ellingson, III ..... 428/53
5,258,217 A * 11/1993 Lewis ..... 428/120
5,381,900 A * 1/1995 Marra ..... 206/446
5,441,769 A * 8/1995 Ross et al. ..... 427/282
5,531,048 A * 7/1996 Darling ..... 52/188
5,645,912 A * 7/1997 Nelson et al. ..... 428/67
5,761,853 A * 6/1998 Trosper et al. ..... 52/3
5,763,070 A * 6/1998 Kerlek et al. ..... 428/329
5,815,995 A * 10/1998 Adam ..... 52/177
5,930,596 A * 7/1999 Klose et al. ..... 438/98
5,935,676 A * 8/1999 Merriman et al. ..... 428/77
6,143,392 A * 11/2000 Hughes ..... 428/100
6,184,496 B1 * 2/2001 Pearce ..... 219/213
6,216,395 B1 * 4/2001 Kelly ..... 49/467
6,434,779 B1 * 8/2002 Bartlett et al. ..... 15/215

* cited by examiner

*Primary Examiner*—Leslie A. Braun
*Assistant Examiner*—Amy J. Sterling
(74) *Attorney, Agent, or Firm*—Charles I. Brodsky

(57) ABSTRACT

A stair covering material substantially impervious to liquid running the length of a flight of stairs, with a plurality of individually spaced, step-upon treads at the top side and a plurality of individually spaced non-skid, non-slip surfaces at the under side, and with the covering material having a resistive strength to withstand the weight of a person walking thereon, and a flexibility to fold flat between adjacent ones of the individually spaced step-upon treads.

19 Claims, 3 Drawing Sheets

COLLAPSIBLE STAIR COVER

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the construction of multi-level homes and offices, in general, and to a covering for the protection of the between level stairs thereof, in particular.

2. Description of the Related Art

As is well known and understood, dropcloths are conventionally employed to protect finished or carpeted stairs during the construction of a multi-level home or office. Experience has shown, however, that such dropcloths are not only bulky and difficult to deploy (and thereafter fold for storage), but almost impossible to assure that they remain flat in place when positioned, so as to not present any hazard in tripping. Even when carefully smoothed, those types of dropcloths that are typically employed have been noted to absorb paints and other liquids to such an extent that such construction debris oftentimes bleeds through the material used, in staining the wood stairs or carpeting which is the purpose of the dropcloths to protect. As will be recognized by such workers in the construction industry as painters, carpenters and carpet installers, a further problem beyond all of this is the difficulty encountered in trying to gather for later storage such dropcloths once the job is finished. Specifically, in manufacture, they do not easily fold flat or allow for a simple carrying about; to the contrary, they are usually just crumbled up and-gathered in the workers' arms, and just thrown into the bed of the pick-up truck, or into the rear of the van for use at a later jobsite.

SUMMARY OF THE INVENTION

As will be seen from the description that follows, these disadvantages and limitations attending the prior art are overcome through the collapsible stair cover of the invention which is exceedingly easy to deploy, opens substantially flat for use, and-folds to a small package for convenient storage. In fact, with the preferred embodiment to be described, a collapsible stair cover in this embodiment once deployed will be appreciated to cover a 13 step run of stairs—and is collapsible to a 4 inch thickness, some 10 inches wide and of some 30 inches long. In this embodiment, a 20 foot length of 3 mm thick clear plastic is employed as the covering material, with a plurality of individually spaced, step-upon cardboard surfaces and a plurality of individually spaced non-skid, non-slip surfaces glued to the opposite sides of the plastic covering material.

In accordance with a more generalized construction of the invention, the collapsible stair cover will be seen to generally employ-this length of stair covering material of a composition which is substantially impervious to liquid. A plurality of individually spaced, step-upon treads is secured to its top side, and a plurality of individually spaced non-skid, non-slip surfaces are secured to its under side. With the stair covering material having a resistive strength to withstand the weight of a person walking on it, and a flexibility to fold between adjacent ones of the individually spaced treads, the collapsible stair cover is of a fabrication to allow its being folded substantially flat. With individual ones of the non-skid, non-slip surfaces secured to underlie individual ones of the step-upon treads (and, preferably, with each of the non-skid, non-slip surfaces underlying each one of the step-upon treads), a construction is manufacturable which in use allows the cover to be opened up by a-worker standing at the top of a run of stairs, pulling the cover down the stairs to the bottom, which when followed by the worker's walking back up the stairs essentially sets the cover in place, flat and ready for use. The non-skid, non-slip surface secured to the under side retains the cover in position on the stairs, and the step-upon tread provides a friction surface to the shoes in going up and down the stairs to begin with.

When used as a cover for the standard 13-step flight of stairs, a preferred embodiment of the invention utilizes treads spaced some 9 inches apart from one another, and of somewhat greater lengths and widths than those for the underlying non-skid, non-slip surfaces, although such relative dimensions can, of course, be varied.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
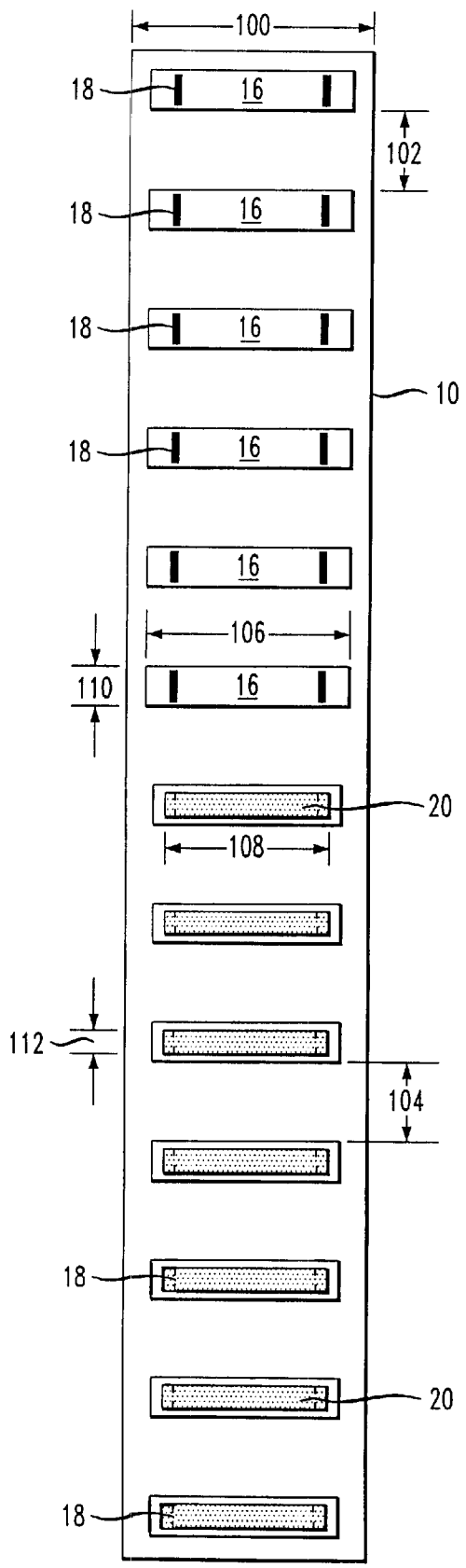
FIG. 1 is a partial top view of a stretched-out collapsible stair cover embodying the invention, helpful in a visualization of a manner by which the cover may be deployed on a 13-step run of stairs between levels of a multi-story structure.

In the drawings, the collapsible stair cover of the invention is shown at 10, understood as being of a material substantially impervious to liquid and having top and under sides 12, 14. Preferably composed of a clear plastic, some 3mm thick, the stair covering material 10 for a 13-step run may be 20 feet in length, and of a 36 inch width 100 in covering each step of the run. A plurality of step-upon treads 16 are secured to the top side 12 of the material 10 (adhesively by glue, for example) individually spaced one-from-another by a distance 102. Such securing materials for the treads are shown at 18 in FIGS. 1 and 2.

Figure 2:
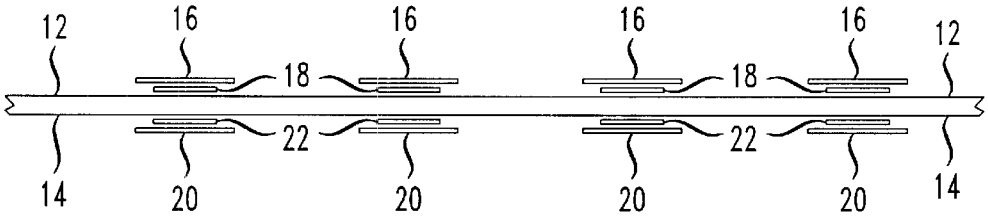
FIG. 2 is a side view helpful in an understanding of the construction of the stair cover of FIG. 1.

The collapsible stair cover of the invention further includes a plurality of non-skid, non-slip surfaces 20 also secured to the covering material 10, securable to the under side 14 by a like adhesive glue 22, as shown in FIG. 2, and in phantom located beneath the lower-6 of the step-upon treads 16 of FIG. 1. In accordance with the invention, the non-skid, non-slip surfaces 20 are also individually spaced one-from-another, as by 104, such that individual ones of the plurality of surfaces 20 underlie individual ones of the step-upon treads 16. In the preferred embodiment of the invention, each non-skid, non-slip surface 20 underlies each individual step-upon tread 16, so that the spacings 102 and 104 are equal, 9 inches in the preferred embodiment of the invention. In such embodiment, the length 106 of the step-upon tread 16 is selected greater than the length 108 of the non-skid, non-slip surface 20, as shown in FIG. 1; at the same time, the width 110 of the step-upon tread 16 is selected greater than the width 112 of the non-skid-non-slip surface 20, although both these relative dimensionings of length and width are matters of design choice. Each non-skid, non-slip surface 20 is securable with the under side 14 of the cover material 10 by the adhesive gluing 22 of FIG. 2. Also shown in FIG. 1 as a matter of design choice is the indication of the lengths 106 and 108 as being less than the width 100 of the cover material 10. In the preferred embodiment, each of the step-upon treads 16 is selected of a ⅛ inch thickness, and each of the non-skid, non-slip surfaces is of a 1/16 inch thickness. When the collapsible stair cover of FIGS. 1 and 2 is employed with a 13-step run of standard construction stairs, a width 100 of some 36 inches may be employed for the cover 10, with the step-upon tread being of a length 106 and with a width 110 of 30 inches and 9 inches respectively. With the thickness of the treads 16 being greater than the thickness of the non-skid, non-slip surface 20, the corresponding dimensions for the length 108 and for the width 112 of the non-skid, non-slip surfaces 20 may be 24 inches and 8 inches, respectively.

Figure 3:
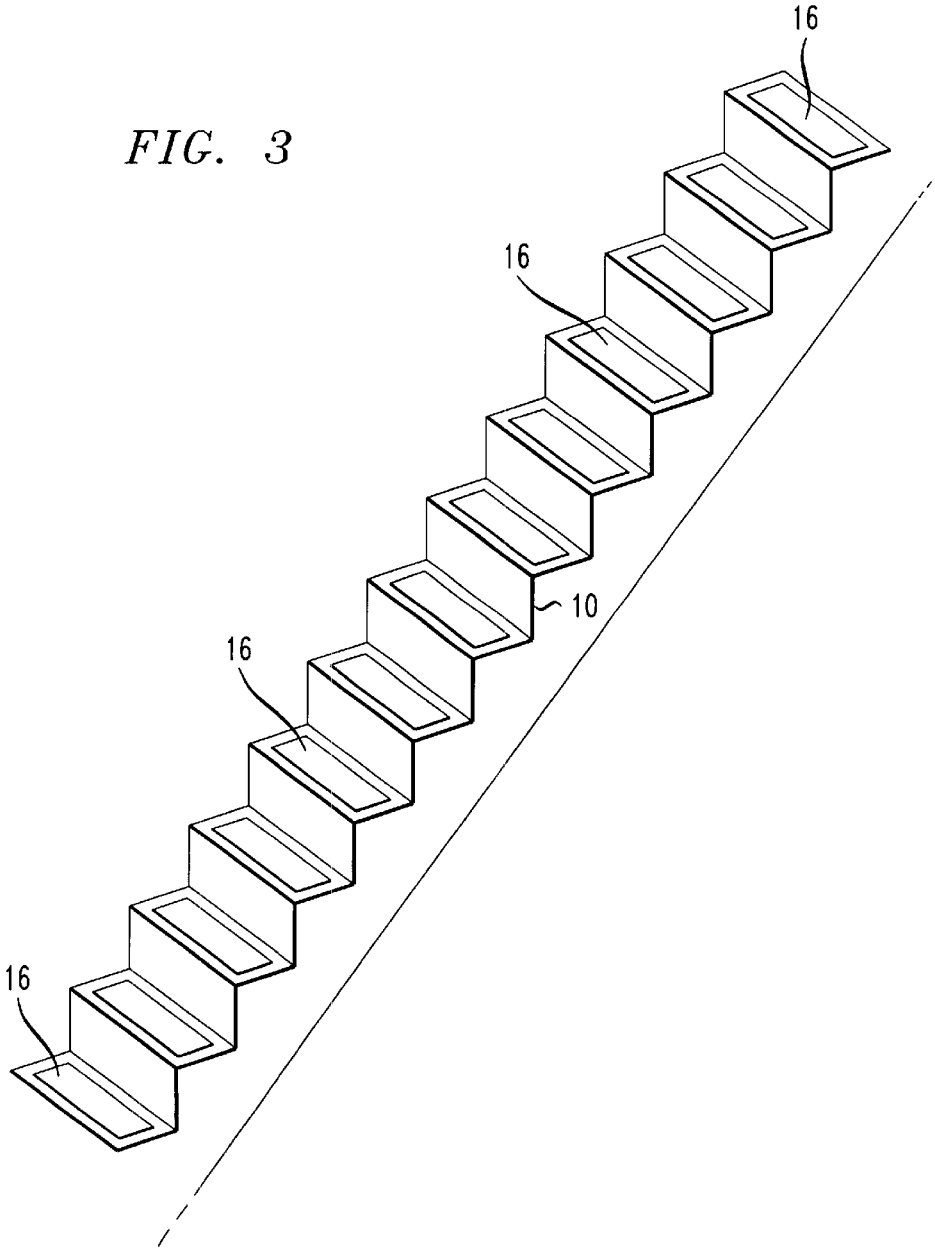
FIGS. 3 and 4 are pictorial views helpful in an understanding of a manner of deploying the cover of FIGS. 1 and 2 on a 13-step staircase.
Figure 4:
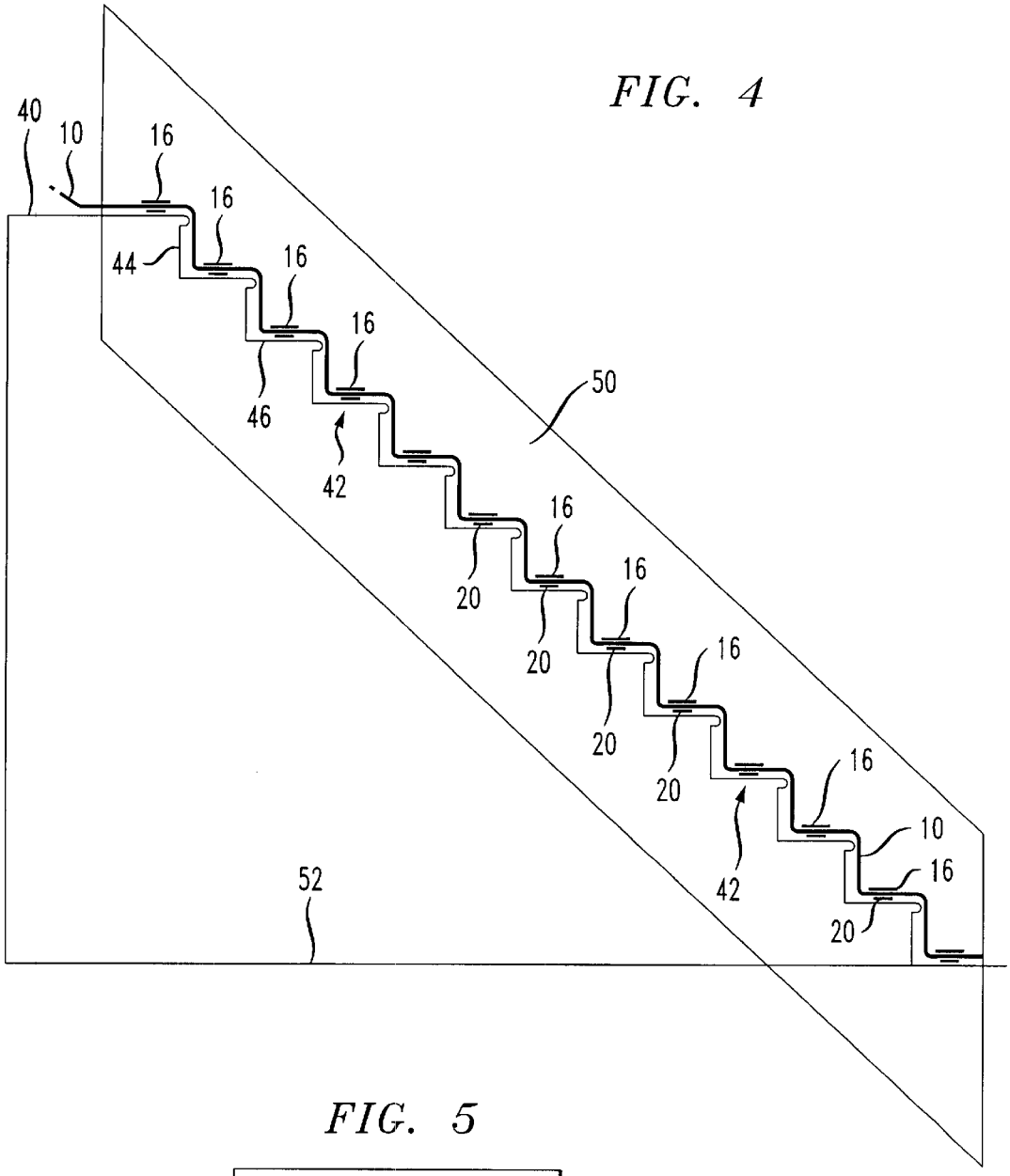
Figure 5:
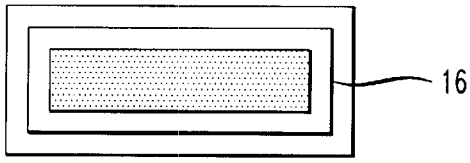
FIGS. 5 and 6 are top and bottom views of the stair cover of FIGS. 1 and 2 once collapsed, and ready for storage.
Figure 6:
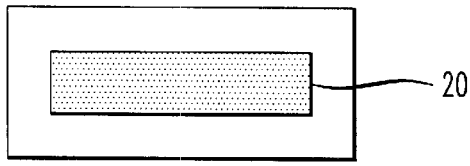

A worker utilizing the collapsible stair cover of the invention then may simply stand at the landing 40 of an upper floor (FIG. 3) and simply pulling the collapsible stair cover 10 down the flight of stairs 42, covering the risers 44 and steps 46 in so doing. By separating the step-upon treads 16 a pre-selected amount based upon the width of the step 46 and the height of the riser 44, a layout as shown in FIG. 4 results, in which the non-skid, non-slip surfaces 20 then rest upon each step 46. In a showing without the stairs 42, the configuration of FIG. 3 results, while FIG. 4 shows the arrangement once the worker walks either down the stairs 42 or up the stairs 42, securing the stair cover 10 in position. By selecting the cover material of a resistive strength to withstand the weight of the person walking upon the stairs, the cover falls into the desired position, and by having a flexibility for the cover material to allow it to fold between the adjacent step-upon treads 16, the cover is then secured in place, substantially impervious to liquid flow. With the treads 16 of a cardboard composition, and with the dimensions selected for the thickness of the plastic and for such cardboard, a worker is able to install the cover 10 by walking it upwardly from the bottom a few steps at a time or by pulling it out downwardly from the top step in FIGS. 3 or 4, resulting in an accordioning of the cover 10 to a collapsed thickness of 4 inches, with an outward dimension a width 100 across and a depth slightly larger than the width 110—for example, 10 inches. The collapsible stair cover 10, taking on the top view of FIG. 5 and the bottom view of FIG. 6, can then be simply and easily stored away for future use.

While there have been described what are considered to be preferred embodiments of the present invention, it will be readily appreciated by those skilled in the art that modifications can be made without departing from the scope of the teachings herein. For example, and as will be understood, any appropriate non-skid spray may be applied to the top surface of the-step-upon treads 16 in providing a further degree of traction, whether as part of a manufacturer's logo or otherwise, in enhancing the overall performance. For at least such reason, therefore, resort should be had to the claims appended hereto for a true understanding of the scope of the invention.

I claim:

1. A collapsible stair cover, comprising:

a first length of stair covering material substantially impervious to liquid, and having top and under sides;

a plurality of individually spaced step-upon treads secured to said top side of said covering material;

a plurality of individually spaced non-skid, non-slip surfaces secured to said under side of said stair covering material;

and with said stair covering material having a resistive strength to withstand the weight of a person walking thereon, and a flexibility to fold between adjacent ones of said individually spaced step-upon treads; and wherein said stair covering material is of a flexibility to fold adjacent ones of said individually spaced step-upon treads substantially flat one atop another for storage and to unfold said adjacent ones of said step-upon treads vertically offset with respect to one another when draped down for covering a set of stairs.

2. The collapsible stair cover of claim 1 wherein individual ones of said plurality of individually spaced non-skid, non-slip surfaces are secured to said under side of said stair covering material to underlie individual ones of said individually spaced step-upon treads secured to said top side of said stair covering material.

3. The collapsible stair cover of claim 2 wherein each of said plurality of individually spaced non-skid, non-slip surfaces is secured to said under side of said stair covering material to underlie each of said individually spaced step-upon treads secured to said top side of said stair covering material.

4. The collapsible stair cover of claim 2 wherein each of said plurality of step-upon treads secured to said top side of said stair covering material is spaced apart one-from-another a distance of substantially 9 inches.

5. The collapsible stair cover of claim 2 wherein each of said plurality of step-upon treads secured to said top side of said stair covering material is of a length of substantially 30 inches.

6. The collapsible stair of claim 2 wherein each of said plurality of step-upon treads secured to said top side of said stair covering material is of a width of substantially 10 inches.

7. The collapsible stair cover of claim 2 wherein each of said plurality of step-upon treads secured to said top side of said stair covering material is of a thickness of substantially ⅛ inches.

8. The collapsible stair cover of claim 2 wherein each of said plurality of individually spaced step-upon treads is of a cardboard composition.

9. The collapsible stair cover of claim 3 wherein each of said plurality of said step-upon treads is of a length, width and thickness 30 inches, 10 inches and ⅛ inch respectively, and of cardboard composition.

10. The collapsible stair cover of claim 9 wherein each of said plurality of step-upon treads is spaced apart one-from-another a distance of substantially 9 inches, and wherein said first length of stair covering material is of a length of substantially 20 feet.

11. The collapsible stair cover of claim 10 wherein said first length of stair covering material is of a width of substantially 36 inches.

12. The collapsible stair cover of claim 3 wherein each of said plurality of non-skid, non-slip surfaces is of a length less than a length of each step-upon tread it underlies.

13. The collapsible stair cover of claim 3 wherein each of said plurality of non-skid, non-slip surfaces is of a width less than a width of each step-upon tread it underlies.

14. The collapsible stair cover of claim 12 wherein each of said plurality of non-skid, non-slip surfaces is of a length of substantially 24 inches and wherein each of said plurality of step-upon treads is of a length of substantially 30 inches.

15. The collapsible stair cover of claim 13 wherein each of said plurality of non-skid, non-slip surfaces is of a width of substantially 8 inches and wherein each of said plurality of step-upon treads is of a width of substantially 9 inches.

16. The collapsible stair cover of claim 3 wherein each of said non-skid, non-slip surfaces are of length, width and thickness dimension of substantially 24 inches, 8 inches and 1/16 inch, respectively.

17. The collapsible stair cover of claim 3 wherein each of said step-upon treads and each of said non-skid, non-slip surfaces are adhesively secured to said first length of stair covering material.

18. The collapsible stair cover of claim 17 wherein said first length of stair covering material is of a plastic composition.

19. A collapsible stair cover, comprising:

a first length of plastic substantially impervious to liquid, and having top and under sides;

a plurality of step-upon cardboard treads adhesively secured to said top side of said plastic material, individually spaced substantially 9 inches from one another;

a plurality of individually spaced non-skid, non-slip surfaces adhesively secured to said under side of said plastic material, and of length, width and thickness substantially 24 inches, 9 inches and 1/16 inch, respectively;

and with said plastic material having a resistive strength to withstand the weight of a person walking thereon, and a flexibility of fold between adjacent ones of said individually spaced step-upon cardboard treads to fold said adjacent ones of said step-upon treads substantially flat one-atop another for storage and for unfolding said adjacent ones of said step-upon treads vertically offset with respect to one another when draped down to cover a set of stairs.

* * * * *